United States Patent [19]

Shimazaki et al.

[11] 4,320,714

[45] Mar. 23, 1982

[54] HEAT FIXING DEVICE

[75] Inventors: Shigeru Shimazaki; Yasuhiro Uehara; Hiroo Nishide, all of Ebina, Japan

[73] Assignee: Fuji Xerox Co., Ltd., Tokyo, Japan

[21] Appl. No.: 157,733

[22] Filed: Jun. 9, 1980

[30] Foreign Application Priority Data

Jun. 12, 1980 [JP] Japan ..... 54/73002

[51] Int. Cl.[3] ..... F27B 9/28; B05C 21/00

[52] U.S. Cl. ..... 118/60; 118/101; 118/104; 219/216; 430/99; 101/DIG. 13; 361/221; 432/60

[58] Field of Search ..... 118/60, 101, 104; 219/216; 432/60; 430/99; 101/DIG. 13; 361/221; 100/176

[56] References Cited

U.S. PATENT DOCUMENTS 3,235,772 2/1966 Gurin ..... 361/221 X 3,809,854 5/1974 Sanders ..... 219/216

4,179,601 12/1979 Tarumi et al. ..... 219/216

*Primary Examiner*—Shrive P. Beck

*Attorney, Agent, or Firm*—Sughrue, Mion, Zinn, Macpeak & Seas

[57] ABSTRACT

A heat fixing device for use in an electrophotographic copying machine in which an electroconductive layer is provided in the surface of one of the fixing and pressure rolls for preventing charge built up upon the surface of the roll. The layer is preferably provided as an aluminum plated layer covered by a non-adhesive releasing layer made of a material such as tetrafluoroethylene or HTV or RTV silicone rubber. Provision of the electroconductive layer prevents an electric field from forming extending through a sheet carrying an image to be fixed thereby substantially entirely, eliminating any offset produced on the roll.

4 Claims, 4 Drawing Figures

HEAT FIXING DEVICE

BACKGROUND OF THE INVENTION

The present invention relates to an improved heat fixing device for an electrophotographic copying machine.

Heretofore, a heat fixing device used in an electrophotographic copying machine or an electrostatic printing machine or the like was provided with a fixing roll having a heat source in the interior thereof and a pressure roll for pressing a sheet to be fixed against the fixing roll. The outer layer portion of the fixing roll is formed of a non-adhesive non-stick layer such as tetrafluoroethylene or HTV silicone rubber or RTV silicone rubber to prevent offset of the toner image on the sheet while at the same time the surface of the releasing layer is coated with a releasing agent.

Since offset is still produced for both cases when the surface temperature of the fixing roll is too high or too low, the surface temperature of the fixing roll has to be carefully controlled so that no offset is produced. Even in spite of this precaution, a minute amount of offset nonetheless tends to be produced on the fixing roll. The cause of this phenomenon was heretofore considered to be related to such factors as the quantity of toner used, the material and surface temperature of the fixing roll, the pressing force, the feeding rate of the releasing agent, and the time required for the sheet to pass between the fixing roll and the pressure roll. In addition thereto, the adhesive force between the toner and the fixing roll and the cohesive force of the toner were also believed to be significant factors.

Even if these factors are controlled precisely, a minute amount of offset is still produced on the fixing roll. As a result of investigations carried out to determine the cause, it was found that the offset is produced because the fixing roll and/or the pressure roll is charged with static electricity due to friction with the copying sheet when the sheet passes between the fixing roll and the pressure roll. Particularly the surface of the pressure roll, which is formed mostly by an insulating material such as silicone rubber except for a core portion, is charged to a negative high voltage of several thousand to several tens of thousand volts which produces an electric field between the surface of the pressure roll and the core of the fixing roll together with a charge having a reverse polarity flowed from the ground into the core of the fixing roll. As a result, the toner in the electric field is attracted to the side of the fixing roll whereby an offset is produced on the fixing roll.

Yet further, a frictional charge is also produced on a fixing roll having a non-stick layer on its surface but the quantity of charge is small because of the provision of an electroconductive layer constituted by a core inside the surface layer. However, it was found that this had very little effect on offset. Particularly, when the roll core of the fixing roll is coated with tetrafluoroethylene as a heat-resisting agent, the amount of charge produced on the roll surface due to friction is small.

Accordingly, it is considered desirable as a means for preventing charge accumulation to form the surface of the pressure roll as an electroconductive layer and as a means for preventing offset on the fixing roll to reduce the charging potential by providing an electroconductive layer at the inner surface layer of the pressure roll for the fixing roll while at the same time changing the direction of the electric field between the fixing roll and the pressure roll. For forming the surface of the pressure roll as an electroconductive layer, the pressure roll must be manufactured by incorporating an electroconductive material into the elastic body because no presently known elastic materials have sufficiently high electroconductive and heat-withstanding properties. Therefore problems may arise with respect to the durability, abrasion-resisting properties and releasability of the roll.

In consideration of these difficulties, an object of the invention is to provide a heat fixing device in which a grounded electroconductive layer is provided on the inner surface layer of the pressure roll to reduce the charging potential of the surface while at the same time changing the direction of the electric field whereby the offset on the fixing roll is nearly completely prevented.

SUMMARY OF THE INVENTION

This, as well as other objects of the invention, are by a heat fixing device in which a sheet to be fixed is pressed against the surface of a fixing roll with a heat source disposed within the fixing roll. A pressure roll is used to press the sheet against the surface of the fixing roll so that the toner image on the sheet is heated and fixed thereon. In accordance with the invention, a grounded electroconductive layer is provided in at least one of the surface layers of the fixing roll or pressure roll.

DESCRIPTION OF THE PREFERRED EMBODIMENTS

Figure 1:
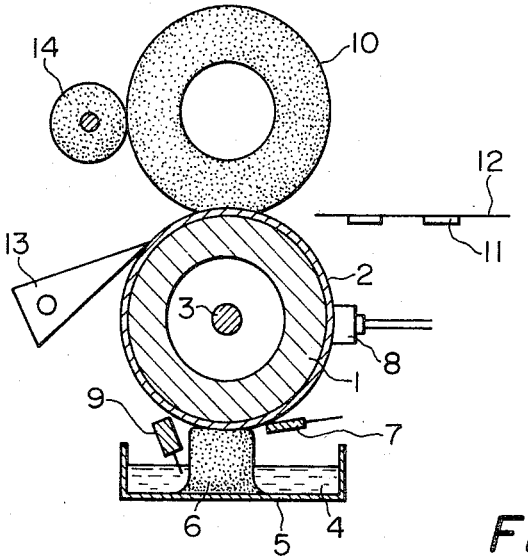
FIG. 1 PRIOR ART
FIG. 1 shows the general construction of a conventional fixing device.

The invention will now be described referring to a preferred embodiment shown in the drawings. FIG. 1 shows a conventional fixing device provided in an electrophotographic copying machine. Reference numeral 1 indicates a fixing roll the surface of which is covered with a heat-resistant non-stick layer 2 made of a material such as tetrafluoroethylene or HTV or RTV silicone rubber. A heat source 3 such as an infrared quartz lamp is provided which heats the surface of the fixing roll 1. A feeding member 6 disposed in a tank 5 which is filled with a releasing agent 4 contacts the surface of the releasing layer 2 of the fixing roll 1 to apply the releasing agent 4 to the surface of the fixing roll 1. Reference numeral 7 designates a doctor blade for keeping the thickness of coating film constant, 8 a temperature sensor for detecting the surface temperature of the fixing roll 1, and 9 a cleaning blade. A pressure roll 10 having a heat-resistant elastic body is provided above the fixing roll so as to press a sheet 12 on which a toner image 11 has been transferred against the surface of the fixing roll 1. The sheet 12 on which the toner image 11 has been fixed by being pressed by the fixing roll 1 is removed from the fixing roll 1 by means of a peeling claw 13 to complete the fixing operation. Reference numeral 14 designates a cleaning roll for cleaning the surface of the pressure roll 10.

Figure 2:
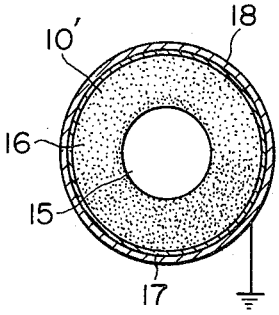
FIG. 2 is a sectional view of a preferred embodiment of a pressure roll of the invention.

FIG. 2 illustrates a pressure roll 10' constructed in accordance with the teachings of the present invention. An elastic layer 16 made of a heat-resistant material such as silicone rubber and having a thickness for example of 6 mm is formed around a steel core 15. An electroconductive layer 17 is provided on the surface of the heat-resistant elastic layer 16 and a non-stick layer 18 is provided on the surface of the electroconductive layer 17.

To manufacture such a roll, the inner surface of the non-stick layer 18, which has previously been shaped to a size capable of fitting over the surface of the heat-resistant elastic layer 16, is plated with aluminum 17 to a thickness of about 300 microns. The non-stick layer 18 is then fitted over the outer periphery of the heat-resistant elastic layer 16. Thereafter, the three members, namely the heat-resistant elastic layer 16, the aluminum-plated electroconductive layer 17, and the non-stick layer 18, are assembled together. The electroconductive layer 17 is electrically grounded. The pressure roll 10' can of course be made by other processes and the electroconductive layer 17 can also be provided on the surface layer of the fixing roll 1 in the same manner as the pressure roll 10'. The electroconductive layer 17 may have the form of a mesh or a coil formed of thin wire and the layer thus formed may be disposed between the elastic layer 16 and the releasing layer 18. The non-stick layer is formed of a non-adhesive non-stick material, such as tetrafluoroethylene, HTV silicone rubber or RTV silicone rubber.

With the roll constructed as discussed above in accordance with the present invention, when the sheet on which a toner image 11 has been transferred passes through the nip formed between the rolls 1 and 10' while being pressed against the fixing roll 1 by the pressure roll 10', no high voltage is applied between the rolls 1 and 10' because a charge having a reverse polarity will flow from the grounded side into the electroconductive layer 17 provided on the surface layer portion of the pressure roll 10' even if the electrostatic charge is generated on the surface of the pressure roll 10' due to friction with the sheet 12.

Figure 3A:
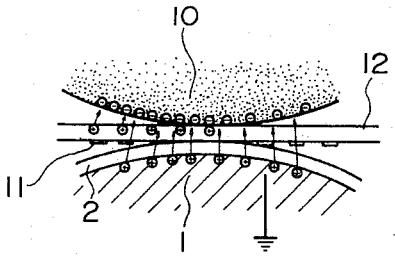
FIG. 3(*a*) shows an electric field in the operation of the conventional fixing device and FIG. 3(*b*) shows an electric field in the operation of the present invention.
Figure 3B:
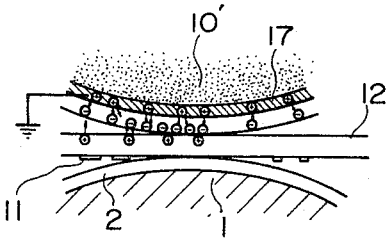

Heretofore in prior art constructions, an electric field extended from the fixing roll 1 to the pressure roll 10 due to the potential produced on the surface of the pressure roll 10 as shown in FIG. 3(*a*). By providing an electroconductive layer 17 on the side of pressure roll 10', the location and direction of the electric field which is changed as shown in FIG. 3(*b*) whereby the electric field formerly extended through the toner image 11, now does not extend over the toner image 11. Accordingly, offset to the fixing roll 1 is positively prevented while at the same time the toner image having the negative charge 11 on the sheet 12 is not repelled by the electrostatic force produced on the pressure roll 10' so that the resolution of copies produced is enhanced.

Furthermore, due to the fact that the offset on the fixing roll 1 is reduced, contamination of the cleaning member which cleans the surface of the fixing roll 1 is decreased and thus the service life of the cleaning member is prolonged.

What is claimed is:

1. In a heat fixing device of the type wherein a sheet to be fixed with an image on one surface thereof is passed over the surface of a fixing roll having a heat source on the interior thereof, and said one surface of said sheet is pressed against said fixing roll by an elastic pressure roll so that a toner image is heated and fixed to said one surface of said sheet, the improvement characterized in that said pressure roll comprises:

a steel core;

an inner elastic layer surrounding said core;

a grounded electroconductive metal layer surrounding said inner elastic layer; and an outer layer formed of a non-adhesive, non-stick insulating material selected from the group consisting of tetrafluoroethlyene or HTV silicone rubber or RTV silicone rubber.

2. The heat fixing device of claim 1 wherein said electroconductive layer comprises a layer of aluminum having a thickness of approximately 300 microns.

3. The heat fixing device of claim 1 wherein said electroconductive layer comprises a mesh of thin wire.

4. The heat fixing device of claim 1 wherein said electroconductive layer comprises a coil of thin wire.

* * * * *